US006627145B2

(12) United States Patent
Eymin et al.

(10) Patent No.: US 6,627,145 B2
(45) Date of Patent: Sep. 30, 2003

(54) GAS-HEATED CARBURIZING EQUIPMENT

(75) Inventors: Max Eymin, Seyssinet-Pariset (FR); Laurent Pelissier, Saint Jean de Moirans (FR)

(73) Assignee: Etudes et Constructions Mecaniques, Grenoble (FR)

( * ) Notice: Subject to any disclaimer, the term of this patent is extended or adjusted under 35 U.S.C. 154(b) by 0 days.

(21) Appl. No.: 09/873,694

(22) Filed: Jun. 4, 2001

(65) Prior Publication Data

US 2002/0017746 A1 Feb. 14, 2002

(30) Foreign Application Priority Data

Jun. 6, 2000 (FR) ..... 00 07232

(51) Int. Cl.[7] ..... C21B 7/24
(52) U.S. Cl. ..... 266/81; 266/252
(58) Field of Search ..... 266/81, 252, 254, 266/257

(56) References Cited

U.S. PATENT DOCUMENTS

| | | | | |
|---|---|---|---|---|
| 4,093,195 A | * | 6/1978 | Schwalm | 266/251 |
| 4,763,880 A | | 8/1988 | Smith et al. | |
| 4,850,334 A | | 7/1989 | Cassagne et al. | 126/91 |
| 4,894,006 A | | 1/1990 | Cassagne et al. | 431/116 |
| 5,033,927 A | | 7/1991 | Pelissier | 414/217 |
| 5,164,145 A | * | 11/1992 | Smith | 266/251 |
| 5,385,337 A | | 1/1995 | Schultz | |
| 6,065,964 A | | 5/2000 | Pelissier | 432/230 |
| 6,159,306 A | | 12/2000 | Barbour | |

FOREIGN PATENT DOCUMENTS

| | | |
|---|---|---|
| EP | 0164221 A | 12/1985 |
| FR | 2678287 A | 6/1991 |
| GB | 2045408 A | 10/1980 |
| JP | 60248909 | 9/1985 |

* cited by examiner

*Primary Examiner*—Scott Kastler
(74) *Attorney, Agent, or Firm*—Duane Morris LLP

(57) ABSTRACT

A cell and an equipment for thermally processing steel parts under low pressure, including heating means formed of several radiant gas tubes distributed around a useful volume of a tight chamber, and control means provided with at least one mode of pulse regulation of the heating means.

8 Claims, 3 Drawing Sheets

GAS-HEATED CARBURIZING EQUIPMENT

BACKGROUND OF THE INVENTION

1. Field of the invention

The present invention relates to the processing of steel parts, and more specifically to a thermal carburizing process, that is, the introduction of carbon into the surface of the parts to improve their hardness. The present invention more specifically relates to carburizing equipment under vacuum or under a low gas pressure (lower than atmospheric pressure).

2. Discussion of the Related Art

In a low-pressure carburizing process parts to be processed are submitted, in an air-tight chamber, to an alternation of steps of enrichment in the presence of a low-pressure carburizing gas and of steps of diffusion under vacuum or under a low-pressure neutral atmosphere. The respective durations of the enrichment and diffusion steps as well as their number especially depend on the desired carbon concentration and case depth in the parts, and such processes are well known in the art. An example of a low-pressure carburizing process is described in French patent application N° 2,678,287 of the applicant. A carburizing process is a thermal processing at high temperature (generally in the range of 800° C. to 1000° C., or even more) and the heating as well as the maintaining at a homogeneous temperature of the parts in the diffusion and enrichment steps are a key point of carburizing processes.

The present invention also relates to carbonitridation, having, as only difference with respect to the carburization, the enrichment gas used, to which ammonia is generally added. The well known result thereof is the forming of nitride (instead of carbide for the carburization) at the part surface. It should thus be understood that the following explanations in relation with carburization also applies to carbonitridation.

Generally, carburizing chambers define volumes of one or several cubic meters which are heated and maintained at the carburizing temperature by electrical heating means. In practice, electrical resistors in the form of bars, which are distributed at the periphery of the carburizing volume, that is, around the carburizing chamber, according to the desired thermal distribution and to the thermal bridges linked to the chamber structure, are used.

It would be desirable to have another carburizing chamber heating energy instead of electricity.

The first energy that comes to mind is gas, which is a "clean" and inexpensive energy. However, the use of gas for heating carburizing chambers raises a great number of problems which have led, up to now, to preferring electrical heating, in particular for low-pressure equipment.

A first problem has to do with the very structure of gas burners, which must heat up the internal space of the chamber without introducing any gas combustion smoke therein. In this regard, the necessary length of the burners due to the large dimensions of the carburizing chambers is a critical point in terms of heat distribution in the chamber.

A gas burner system which would be of proper use corresponds, for example, to the burner system described in U.S. Pat. No. 4,894,006. This burner system is formed of a tight external envelope and of a central furnace tube delimiting a combustion chamber. Such a system uses a recirculation of the burned gases and enables the gases to come out at high speed. This burner system may be associated with an internal tube of the type described in U.S. Pat. No. 4,850,334. The respective contents of the above-mentioned publications being incorporated by reference.

Another problem linked to the use of gas tubes for the heating of a carburizing chamber, in particular a low-pressure chamber, has to do with the bulk of these tubes, which is substantially greater than the bulk of electrical resistive bars. This bulk goes against an adequate distribution of gas tubes in the periphery of the useful volume of the chamber to obtain a homogeneous distribution of the temperature.

Another problem is the necessary regulation of the thermal power of the used heating source. Indeed, the batch of parts to be carburized must first be brought to a high carburizing temperature. Then, this temperature must be homogeneously maintained during the steps linked to the carburization. In an electrical system, the temperature regulation is particularly easy to perform by modulation of the current in the heating elements. Such a solution cannot be transposed to gas burners

SUMMARY OF THE INVENTION

An object of the present invention is to provide a gas-heated carburization cell that overcomes the above-mentioned disadvantages.

Another object of the present invention is to provide a solution which is compatible with the current distribution of the heating means at the periphery of a carburization cell.

Another object of the present invention is to provide a modular carburization equipment that takes advantage of the use of gas as a heating power source.

To achieve these objects, the present invention provides a low-pressure cell for thermally processing steel parts, including heating means formed of several radiant gas tubes distributed around a useful volume of a tight chamber; and control means provided with at least one mode of pulse regulation of the heating means.

According to an embodiment of the present invention, the control means are adapted to controlling the heating means according to two operating phases, respectively of full power preheating and of temperature hold in pulse regulation.

According to an embodiment of the present invention, the control means are adapted to modifying the gas flow between two levels, respectively a maximum level for the preheating and an intermediary level for the pulse regulation.

According to an embodiment of the present invention, all radiant gas tubes are individually controlled or controlled by groups.

According to an embodiment of the present invention, the control means include a programmable state machine for individualizing control signals to be sent to the different tubes.

The present invention also provides an equipment for thermally processing steel parts under low pressure, including several processing cells connected to a common tight chamber provided with handling means for transferring a load from one cell to another, at least one cell being of the above-mentioned type.

According to an embodiment of the present invention, at least one cell is dedicated to the preheating of a load to be carburized, and at least one cell is a carburization cell.

According to an embodiment of the present invention, the carburization cell is provided with gas heating means adapted to being controlled in pulse regulation mode.

The foregoing objects, features and advantages of the present invention, will be discussed in detail in the following non-limiting description of specific embodiments in connection with the accompanying drawings.

Figure 2:
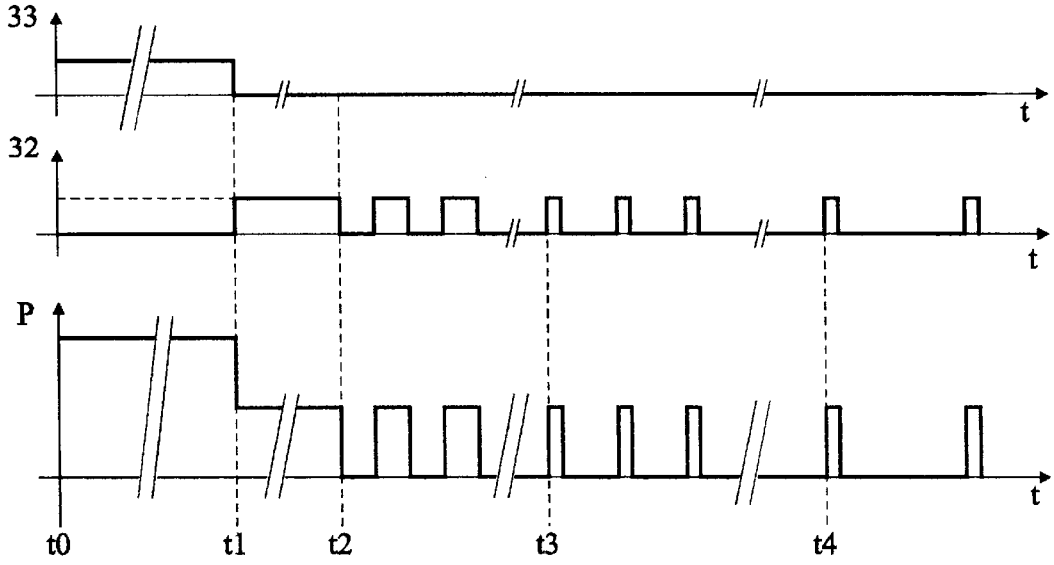
FIG. 2 illustrates, in the form of timing diagrams, an embodiment of a gas burner control method according to the present invention.

For clarity, the diagrams of FIG. 2 are not to scale. Further, only those elements that are necessary to the understanding of the present invention have been shown in the drawings and will be described hereafter. In particular, in FIG. 3, only the multiple-cell structure of an equipment has been shown, with no consideration for the details constitutive of the cells which, unless otherwise mentioned, are conventional.

DETAILED DESCRIPTION

A feature of the present invention is to provide a pulse control of gas burners of a thermal processing cell, at least during temperature hold phases after a preheating phase. Thus, according to the present invention, gas burners of the type of those described in above-mentioned U.S. Pat. No. 4,894,006 are used, and these burners are controlled to obtain, at least after a preheating phase, a pulse regulation.

It could have been devised to modulate the gas flow of the burner to adapt the power to obtain the regulation. However, such a solution would raise, for a low gas flow, problems of outlet of the smokes in the burner. Indeed, burners are generally adapted for an optimal discharge of smokes in a given flow range and an operation under a very low gas flow enables obtaining neither a homogeneous distribution of the temperature in the tube, nor a correct smoke power recovery. Further, this may pose problems of flame stability.

Preferably, to improve the homogeneity of the tube heating power, a switching between two air and gas flows according to the burner's operating mode is performed. Thus, so-called dual air and gas flow burners enabling operation with a first maximum flow for a preheating phase and operation with a second intermediary flow for the regulation phase are provided. According to the present invention, the intermediate gas flow does not correspond to the minimum flow of the burner, so that the two flows provide an acceptable temperature homogeneity, with a correct recovery of smokes in the burner.

Figure 1:
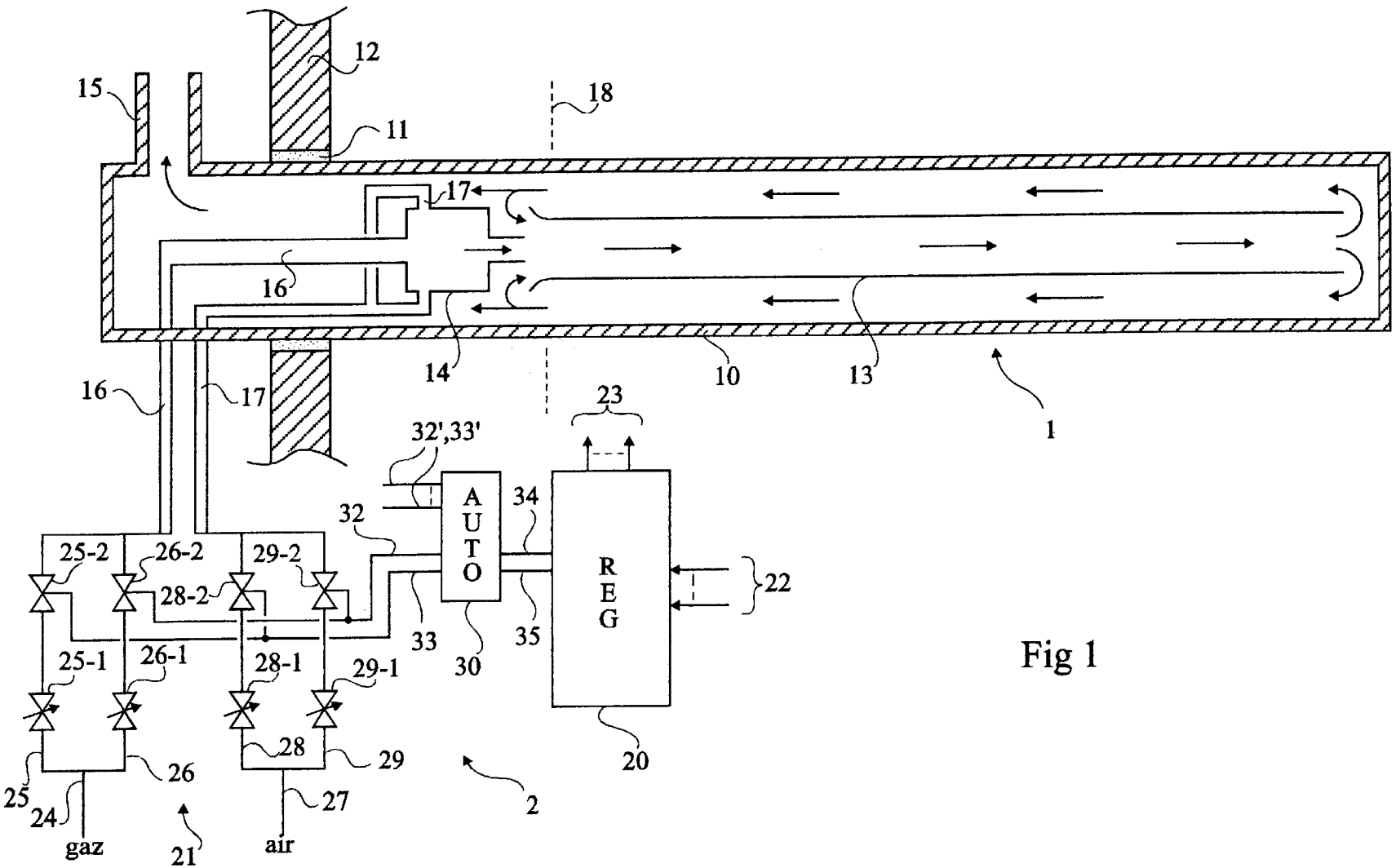
FIG. 1 is a simplified view, partially in cross-section, of an embodiment of a gas burner system in a thermal processing cell according to the present invention.

FIG. 1 illustrates an embodiment of the present invention. This drawing very partially shows a thermal processing cell in that it shows a single gas burner 1 and a system 2 of control of the gas burners in the cell.

Gas burner 1 is essentially formed of an external radiant envelope 10 shaped as a glove finger which crosses, via a vacuum-tight system 11, wall 12 of the processing cell. The burner also includes a tube 13, internal to envelope 10 and coaxial thereto. A first end of tube 13 is close to the end of envelope 10 in the carburization cell. A second end of tube 13 is open in the direction of an outlet of a combustion chamber 14 wherein the air and gas for the burner are mixed. As illustrated by arrows in FIG. 1, the burner is preferably a smoke recirculation burner, that is, part of the combustion smokes are used to be reintroduced at the inlet of tube 13, the rest of the smokes being discharged through a vent 15 of envelope 10 outside of the cell. For clarity, the burner has been very schematically shown and, in particular, the flame ignition means have not been illustrated. Chamber 14 includes at least one gas supply 16 and at least one air supply 17. Generally, several air supplies are provided to better homogenize the gas-air mixture to be burnt. Air supply ducts 16 and 17 come out of envelope 10 outside of the carburization cell.

Preferably, the position of burner 1 with respect to the wall of chamber 12 is such that the entire tube 13 is contained in the internal volume of the carburization cell. However, the entire tube 13 is preferably not contained in the so-called "hot" volume of the carburization chamber, which is generally delimited by a thermal screen (symbolized by dotted lines 18). Similarly, chamber 14 itself is in the internal volume of the cell, but preferentially outside of the hot volume. The position of burner 1 is chosen so that the portion of tube 13 in the hot volume is homogeneous in temperature. In an embodiment of the present invention, the adapting of the burner position is performed by displacing it entirely (including envelope 10) with respect to wall 12 of the chamber, to adjust the position of the inlet of tube 13 with respect to thermal screen 18.

Preferably, all gas burners of the thermal processing cell are controlled by a same regulation system 2. System 2 essentially includes an electronic regulation circuit (REG) 20 (in practice, one or several circuits) and a network 21 of valves controlled by circuit 20, possibly by means of a programmable state machine 30 (AUTO), as will be seen hereafter. To ensure the regulation function, circuit 20 receives measurement and control signals 22. The measurement signals are essentially formed of measurement results provided by at least one temperature sensor in the carburization chamber. The control signals come from a control unit accessible by the operator. Regulation circuit 20 (or state machine 30) provides control signals 23 to the gas burners to light and extinguish their respective flames.

According to the present invention, circuit 20 also controls network 21 of gas and air valves. This valve network is used to control the respective gas and air flows of the different burners.

To simplify FIG. 1, the gas and air ducts have been shown in a single-line manner in valve network 21. It should be noted that the valve structure illustrated in FIG. 1 is preferably reproduced for each burner.

In the exemplary embodiment of FIG. 1, a main gas supply duct 24 is distributed in two ducts 25 and 26 respectively associated with flow limiters 25–1 and 26–1. Ducts 25 and 26 have, according to the present invention, different flows. For example, duct 25 is intended for providing, in association with limiter 25–1, a maximum gas flow for the burner operation at maximum power during at least one preheating phase. Duct 26 is intended for providing, in association with limiter 26–1, a smaller gas flow for the burner operation in the pulsed state of the present invention. On the air circuit side, a main duct 27 is divided in two ducts 28 and 29 respectively associated with limiters 28–1 and 29–1, the functions of which are similar to those discussed hereinabove in relation with the gas supply. Preferably, the flows imposed by limiters 25–1, 26–1, 28–1, and 29–1 are preset.

According to the present invention, each of ducts 25, 26, 28, and 29 is associated with an all or nothing control valve

25–2, 26–2, 28–2, 29–2. Valves 26–2 and 29–2 are preferably simultaneously controlled by a signal 32 provided by circuit 20 (or by state machine 30) in pulsed state. Valves 25–2 and 28–2 are preferably simultaneously controlled by a signal 33 coming from circuit 20 or from state machine 30. The ends of ducts 25, 26 and 28, 29 are connected to their respective opposite ends.

The operation of a gas burner system according to the present invention will be discussed hereafter in relation with FIG. 2 which shows, in the form of timing diagrams, an example of signal 33, of signal 32, and of the corresponding instantaneous power P of the gas burners.

In the embodiment of FIG. 2, the burner is first used, in a preheating phase (times t0 to t1), at maximum power, that is, at the greatest gas and air flow. During this preheating phase, valves 25–2 and 28–2 are opened at the maximum flow. The maximum flow may be provided to be set by the sum of the flows of all limiters. In this case, valves 26–2 and 29–2 are also opened. Then, an intermediary phase during which the burner power switches to the lower flow with no pulse regulation is preferably provided (time t1 to t2). For this purpose, from time t1, burner 1 operates in intermediary power. Accordingly, control signal 33 switches to close valves 25–2 and 28–2 and signal 32 switches to open (if they are not already open) valves 26–2 and 29–2. Time t1 is determined by the approaching of a temperature reference point smaller than the desired regulation temperature. The intermediary phase between times t1 and t2 may, in particular, be used to avoid exceeding the temperature reference point due to the system inertia.

From time t2, an hold operation of the carburization chamber temperature is performed. From this time, the pulsed regulation signal 32 adapts, according to the parameters received by circuit 20 through signals 22, the respective opening durations of valves 26–2 and 29–2. In the example of FIG. 2, it is assumed that, between times t2 and t3, the power desired for the burner is relatively high and requires relatively long pulses. It may be, for example, a phase of adaptation of the burner power change between its maximum and intermediary levels. From time t3, an actual regulation phase begins, wherein the duty cycle of the burner lighting pulses exclusively depends on the temperature variations in the carburization chamber. These variations may be due, for example, to a modification imposed by the carburizing process or to a load transfer in the cell. In FIG. 2, a need for power decrease from time t4 has been shown.

It should be noted that the respective ON and OFF times of the burners are established, among others, according to the arrangement of the burners in the chamber and to their structure.

As an alternative, the burners may be controlled in pulsed state even in their full power operation.

Although it is possible to provide a simultaneous excitation of all burners in the chamber, it is preferred to individualize the control of the different burners of the carburizing cell. For example, longer ignition times may be provided for burners located close to thermal bridges formed, for example, by the legs supporting the load to be heated up. In this case, the state machine 30 provides individual controls (signals 32' and 33' for other burners not shown), for example, by successively putting off the burner ignition and by adapting the durations of the ignition pulses to the different burners. State machine 30 has a preestablished operation and receives, among others, control signals 34 and 35 coming from the regulator and common to all burners, the state machine being in charge of adapting these signals to the different burners.

On this regard, it should be noted that the different burners will be distributed in the carburizing cell according to the desired thermal homogeneity. For example, it may be desired to have at the bottom of the carburizing cell, that is, in the vicinity of the legs supporting the load, a greater power with an equal rate or a longer heating time to improve the vertical homogeneity. In the longitudinal cell direction (in the longitudinal burner direction), the homogeneity adjustments essentially depend on the choice of the intermediary frequency, which is a function of the burner length, and thus of the chamber volume.

As an alternative, the burners may be controlled by groups.

Figure 3:
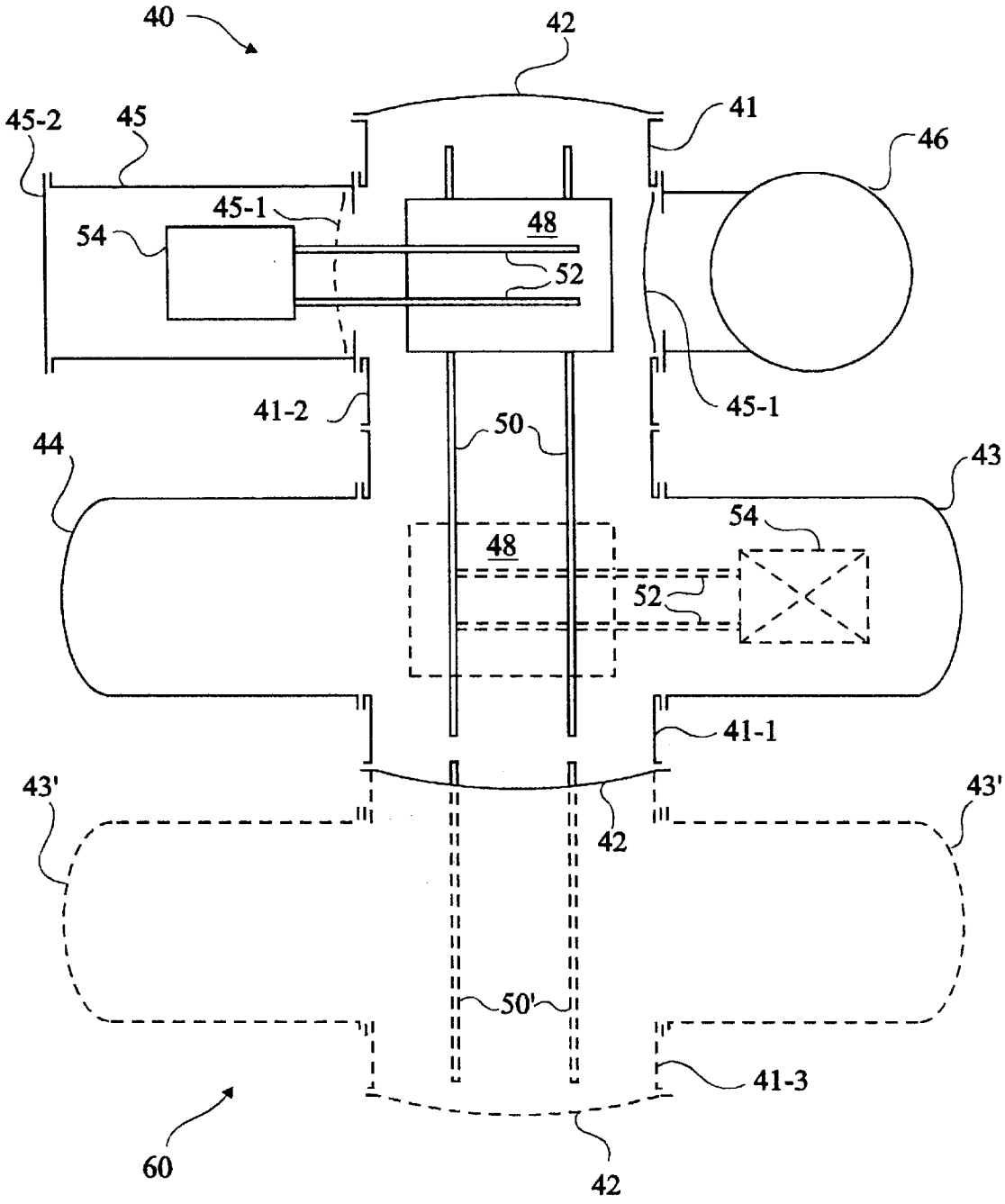
FIG. 3 very schematically shows an embodiment of a modular processing equipment implementing the present invention.

FIG. 3 illustrates an example of application of the present invention to a modular equipment of carburizing cells. The embodiment of FIG. 3 is inspired from a modular equipment such as described in U.S. Pat. No. 6,065,964 of the applicant which is considered as known.

A base unit 40 includes a tight chamber 41 in the form of a cylinder (of non-necessarily circular section) with a horizontal axis. The two ends of this cylinder 41, provided with flanges, are closed by removable tight covers 42. The processing cells are laterally connected to cylinder 41 and are in a same horizontal plane. For example, two thermal processing cells 43 and 44, for example intended for containing two loads to be carburized, are arranged in front of each other and are connected to a first transfer caisson 41–1 constitutive of cylinder 41. A loading cell 45 is arranged in front of a quenching cell 46, these cells being connected to a second transfer caisson 41–2, itself axially connected to caisson 41–1.

A handling device is in the form of a trolley 48 moving parallel to the axis of cylinder 41, from one transfer caisson to another. This trolley moves, for example, on rails 50 extending all along cylinder 41. The trolley is provided with a telescopic fork 52 likely to extend on either side of trolley 48 to the center of each of cells 43 to 46, to take therefrom and deposit therein a load 54 under processing. In FIG. 3, in full line, trolley 48 is at the level of cells 45 and 46, and telescopic fork 52 penetrates into cell 45 to take therefrom a load 54. Of course, cell 45 has been previously put to the low pressure of chamber 41 to open door 45–1 which forms, with outer door 45–2, an inlet lock. In dotted lines, trolley 48 is located at the level of cells 43 and 44. The equipment of FIG. 2 is modular, that is, one or several additional units 60 each formed of a transfer caisson 41–3 provided with rails 50' and of one or two cells 43' can be axially connected to one of caissons 41–1 or 41–2 to complete cylinder 41.

According to a first mode of application of the present invention to a modular equipment such as described hereabove, cells 43, 43' and 44 are usual gas-heated carburizing cells such as previously described.

According to a second mode of application of the present invention to such a modular equipment and according to a second aspect of the present invention, it is provided to dissociate the operations of preheating of a load to be carburized from the temperature hold operations. For this purpose, one of the cells, for example, cell 44 in FIG. 3, is assigned to the preheating of all the loads to be carburized. This cell is then equipped with gas burners to bring the load to be carburized to a temperature close to the working temperature, for example, to a temperature ranging between 600° C. and 800° C. Then, the loads are transferred to the other carburizing cells 43 and 43' in which the only necessary heating operation is intended for the maintaining and the homogenizing of the temperature of the different parts.

Accordingly, the use of the heating means is optimized. The means used in carburizing cells 43 and 43' may remain electrical while those of preheating cell 44 are gas means. However, according to a preferred embodiment of the present invention, gas burners are used even in carburizing cells where only a temperature hold is performed. In this case, a preheating cell using burners of a first type and carburizing cells using burners of a second type, less powerful than the first ones, or the same burners with a smaller flow, may be provided. An advantage of dissociating the preheating and temperature hold functions is that the burners can now be dedicated to a single one of the two functions while all operating at maximum output. Thus, the dual gas flow structure can be spared by providing two types of burners, without having any bulk problem. The burners are then controlled at fixed power (for example, at maximum power) and, at least in carburizing cells, by pulse regulation.

It should be noted that the number of preheating cells to be provided in a modular carburizing equipment itself depends on the number of carburizing cells to be distributed. In a simplified embodiment, a preheating cell with gas burners of a first power type and carburizing cells with gas burners of a second power type will be provided. Cells using dual flow gas burners such as previously described in relation with FIG. 1 may however be implemented, for the preheating cell or for the carburizing cells. Such an embodiment enables optimizing the regulation and homogeneity of the temperature in the load.

Of course, the present invention is likely to have various alterations, modifications, and improvements which will readily occur to those skilled in the art. In particular, the positioning of the gas burners in a carburizing cell or in a preheating cell according to the actual cell structure is within the abilities of those skilled in the art based on the functional indications given hereabove and on the application. Similarly, the control system (circuit 20, state machine 30 and valves 21) may be formed by using known means. Further, the choice of the gas and air flows in the used gas burners depends on the maximum and pulse regulation powers, which are linked to the application. The present invention may also be implemented in a processing equipment of the type described in U.S. Pat. No. 5,033,927 of the applicant where several vertical processing cells are distributed above a tight load transfer chamber. Adapting such an equipment to a gas preheating cell and gas or electrical carburizing cells is within the abilities of those skilled in the art based on the indications given in relation with the horizontal equipment of FIG. 3.

What is claimed is:

1. A low pressure cell (43, 43',44) for thermally processing steel parts, including:

heating means (1) formed of several radiant gas tubes distributed around a useful volume of a tight chamber maintained at a low pressure; and control means (2) provided with at least one pulse regulation mode of the heating means, and including means for controlling the heating means according to two operating phases, respectively a full power preheating phase and a temperature hold phase in pulse regulation.

2. The thermal processing cell of claim 1, wherein the control means (2) include means for modifying the gas flow between two levels, respectively a maximum level for the preheating and an intermediary level for the pulse regulation.

3. The cell of claim 1, wherein all radiant gas tubes (1) are individually controlled.

4. The cell of claim 3, wherein the control means include a programmable state machine for individualizing control signals to be sent to the different tubes.

5. An equipment for thermally processing steel parts under low pressure, including several processing cells (43, 43', 44', 45, 46) connected to a common tight chamber (41) provided with handling means (48, 50, 52) for transferring a load (54) from one cell to another, at least one cell (44) being made in accordance with claim 1.

6. The equipment of claim 5, wherein the at least one cell (44) is dedicated to the preheating of a load to be carburized, and at least another one of the processing cells being a carburizing cell (43, 43').

7. The equipment of claim 6, wherein the carburizing cell (43, 43') is provided with gas heating means adapted to being controlled in pulse regulation mode.

8. The cell of claim 1, wherein all radiant gas tubes (1) are controlled by groups.

* * * * *